United States Patent [19]

Buan

[11] Patent Number: 4,606,270

[45] Date of Patent: Aug. 19, 1986

[54] INKING APPARATUS FOR A VALUE PRINTING DEVICE

[75] Inventor: Danilo P. Buan, Easton, Conn.

[73] Assignee: Pitney Bowes Inc., Stamford, Conn.

[21] Appl. No.: 774,392

[22] Filed: Sep. 10, 1985

Related U.S. Application Data

[63] Continuation of Ser. No. 593,228, Mar. 27, 1984, abandoned.

[51] Int. Cl.[4] ..... B41F 1/46; B41F 1/50

[52] U.S. Cl. ..... 101/359; 101/324; 101/348; 101/295; 101/103

[56] References Cited

U.S. PATENT DOCUMENTS

| | | | |
|---|---|---|---|
| 1,900,008 | 3/1933 | Baumgarten et al. | 101/320 |
| 2,934,004 | 4/1960 | Barker | 101/333 |
| 3,412,679 | 11/1968 | Nirenberg | 101/320 |
| 3,715,980 | 2/1973 | Zurbuchen et al. | 101/333 |
| 3,721,187 | 3/1973 | Levinson | 101/359 |
| 4,052,938 | 11/1977 | Kirby | 101/333 |
| 4,226,183 | 10/1980 | Sato | 101/359 |
| 4,359,940 | 11/1982 | Sato | 101/320 |

*Primary Examiner*—William Pieprz

*Attorney, Agent, or Firm*—Charles G. Parks, Jr.; Albert W. Scribner; William D. Soltow, Jr.

[57] ABSTRACT

An improved value print device having incorporated within the device improved linkages for imparting a reciprocal motion to the carriage, housing and inking roller.

1 Claim, 6 Drawing Figures

FIG. 4.
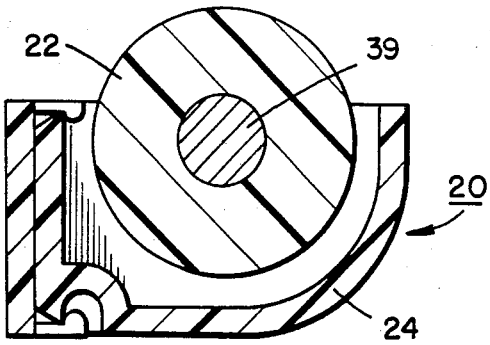
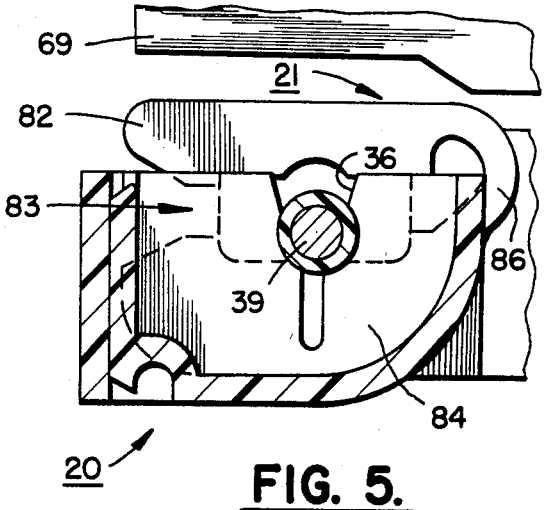
FIG. 5.
FIG. 6.
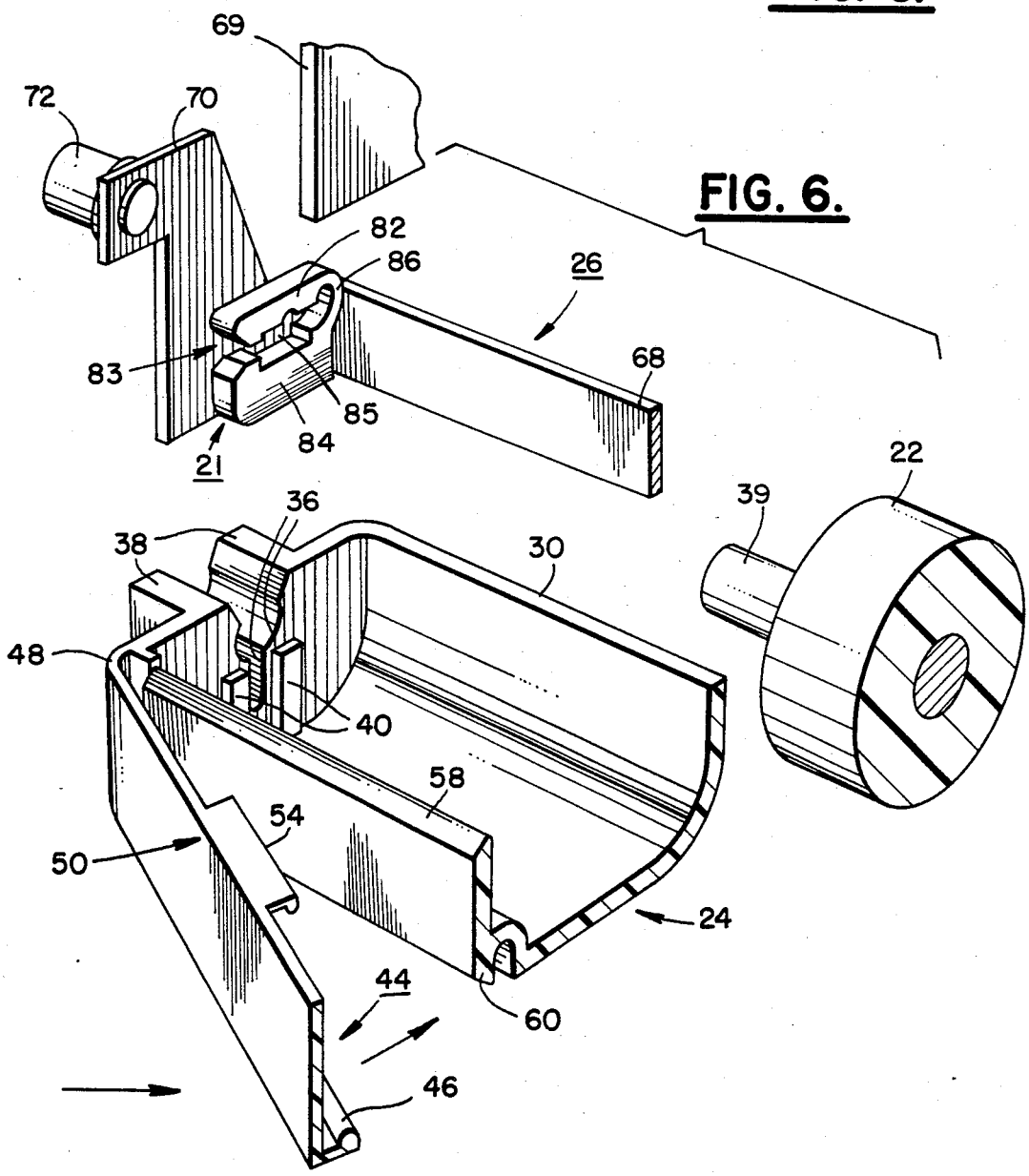

INKING APPARATUS FOR A VALUE PRINTING DEVICE

This application is a continuation, of application Ser. No. 593,228, filed Mar. 27, 1984 now abandoned.

BACKGROUND OF THE INVENTION

This invention relates to an improved value printing device such as for use in a postage meter or register, and, more particularly, to such a device having improved apparatus for detachably coupling a housing with an inking roller to a reciprocal carriage, and for permitting the convenient removal of the housing and inking roller from the carriage.

Cross reference is hereby made to a copending patent application assigned to the same assignee as this application entitled: "Value Printing Device Warning Function For Replacing An Inking Member" by D. Buan et al, Ser. No. 334,934, filed on Dec. 28, 1981. Cross reference is also made to two U.S. Patents assigned to the same assignee as this application. The first is U.S. Pat. No. 4,412,491 entitled: "System For Sensing An Inking Member In A Value Printing Device" by D. Buan et al, and the second patent is U.S. Pat. No. 4,401,031 entitled "Disposable Self-Contained Cartridge For Value Printing Device" by D. Buan. Cross reference is also made to the copending application, assigned to the same assignee as this application, entitled "Inker Mounting Arrangement For a Value Printing Device" D. Buan and A. Eckert U.S. application Ser. No. 593,222, filed on Mar. 27, 1984. These patents and applications are incorporated herein by reference in their entireties.

Value printing devices such as postage meters, labeling apparatus, registers and the like are constructed to print information to a surface such as a mailpiece by contacting the surface with inked print characters. Generally, the print characters are raised against the background of a printing head. In such systems, the inking typically occurs immediately prior to the printing event.

In a postage meter, for example, relative movement occurs between the inking roller and the print characters so that the movement is capable of permitting contact therebetween and, consequently, the inking of the characters. Inking rollers normally contain their own inking supply. While various inventive aspects which follow are described in connection with commercially available postage meters, it will be understood that such aspects apply equally to any printing device with like characteristics.

In rotary head postage meters and registers such as Pitney-Bowes' Models 5300, 6300 and 6500 meters, the print characters are contained on a rotary printing head which revolves relative to a stationery inking roller during the print cycle. When the raised print characters encounter the inking roller, they make contact and, thus, are inked.

In so called flat-bed postage meters, such as a Pitney-Bowes' Model 5700 Series meter, the print characters are contained on a horizontal flat printing head. In the print cycle, the inking roller and its support carriage are moved across the print characters immediately prior to printing. The characters remain stationary during both inking and printing. The mailpiece to be marked, or have postage applied thereto, is raised rapidly against the printhead with enough force to effect the desired marking. After printing and removal of the mailpiece, the inking roller moves back across the printing head to its original rest or home position.

The invention described in this patent application can apply to both rotary and flat-bed postage meters and registers. For the purpose of convenience, the present invention is described specifically with regard to a flat-bed Pitney-Bowes' Model 5700 Series meter which has a well-known configuration and has been available commercially for some time.

Various aspects of this type of postage meter have been described in prior patents. These include U.S. Pat. No. 3,069,084 relating to a registering mechanism, U.S. Pat. No. 3,244,096 relating to an imprinting machine with controlled imprinting force, and U.S. Pat. No. 3,310,139 relating to a drive system. Also, U.S. Pat. No. 3,143,963 is of note in that it relates to an apparatus for limiting the number of cycles of a postage meter in accordance with the capacity of the inking roller and, thereafter, rendering the inking roller unfit for use in the postage meter.

The prior art devices use drive mechanisms for their carriages, cartridges, housings, inking rollers, and so forth which are fairly expensive, and quite heavy. In addition, they require precise manufacturing tolerances, take up a relatively large amount of space, and employ large stepping motors. The prior art devices are improved in the present invention due to the various improved parts, constructions, arrangements of elements and the like.

SUMMARY OF THE INVENTION

The present invention constitutes an improvement over the prior art value printing devices. More specifically, the present invention includes an inking roller and a housing for supporting the inking roller. The combination of the housing and inking roller constitutes a cartridge. The cartridge is supported on a reciprocal carriage which receives and positively maintains the housing and associated ink roller in the proper orientation during their operating cycle. The device includes a linkage arrangement designed to effect the reciprocal motion of the carriage, housing and inking roller during normal operation through a simplified rotational cam, follower and pivotable linkages. The use and arrangement of these parts reduces the required precision machining, cost and space of such components over prior structures while providing the desirable movement of the operating components.

DESCRIPTION OF THE DRAWINGS

The above-mentioned and other features of the invention will become apparent and the invention itself better understood with reference to the following detailed description of preferred embodiments taken in conjunction with the accompanying drawing in which:

FIG. 4 is a vertical cross sectional view of the cartridge of the present invention taken along sectional line 4—4 of FIG. 2.

FIG. 5 is a vertical cross sectional view of the cartridge of the present invention taken along section line 5—5 of FIG. 2.

FIG. 6 is an exploded front perspective view similar to FIG. 2, but showing one end of the housing, inking roller and cartridge with the inker and housing in an enlarged illustration.

DETAILED DESCRIPTION

Figure 1:
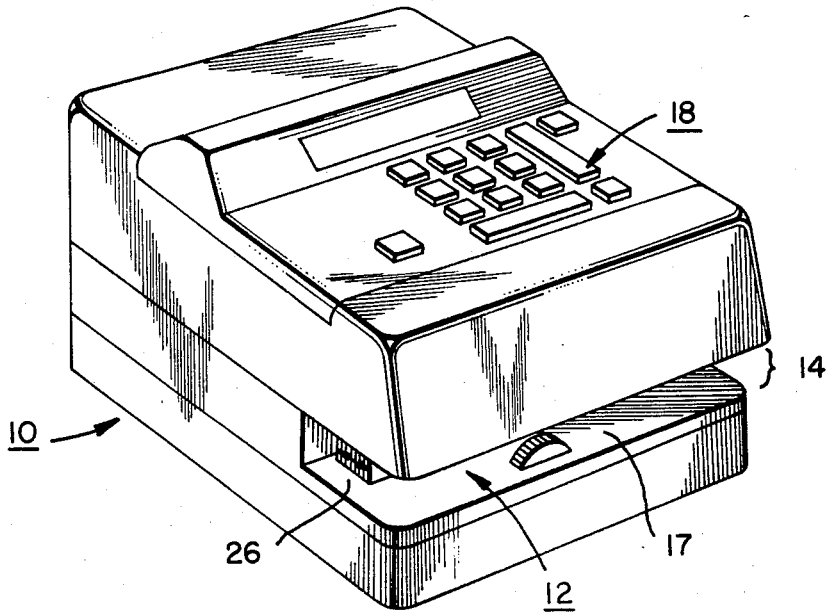
FIG. 1 is a front perspective view of a typical flat-bed postage meter.

Referring now to FIG. 1 of the drawings, a typical, commercially available, flat-bed postage meter or device 10 is illustrated. An example of such device is a Pitney-Bowes' Model 5700 Series meter. A printing station 12 is provided comprising a recess 14 into which a mailpiece is inserted for postal impressions in a manner well known in the art. Various aspects of this type of postage meter are described more fully in U.S. Pat. No. 3,143,963 and in several of the other above-referenced patents and applications.

When a mailpiece is positioned in the recess 14 properly so as to activate a switch (not shown), the platen 17 is caused to move rapidly upward to force the mailpiece against the indicia carrying printing head 16 (FIG. 2) containing the raised print postage or print characters so as to be marked as desired. In the Model 5700 Series meter, the movement of the device, the setting of the postage values and the memory unit are all controlled electromechanically and activated when the operator utilizes the console keyboard 18.

The print characters contained on the printing head are inked just prior to printing. This is effected through a rotatably mounted inking roller 22 which is supported in an inking housing 24. The combination of these elements make up a cartridge 20 which can be made to be replaceable in the meter. The cartridge 20 is mounted for movement from front to rear and then back to front again by carriage 26 as shown by the arrow in FIG. 1.

At the start of the printing cycle, the carriage 26 is in its rest, forward or home position. When the mailpiece is inserted into the recess 14 and the printing cycle begun, the carriage 26 is automatically reciprocated rearwardly to an internal position within the device. As the carriage 26 thus moves, the roller 22 of cartridge 20 is wiped across the print characters of the printing head 16 with the indicia effecting, preferably, a rolling motion to the inking roller. The characters are thus inked during this portion of the cycle. When the carriage 26 is in its rearward, internal or retracted position, the platen 17 moves the mailpiece upward against the printing head 16 to place thereon the ink indicative of the postal values. After manual removal of the mailpiece, the carriage 26 is automatically returned or moved back to its home position to complete the inking cycle. The drive means for automatically producing this motion is described more fully hereafter.

When the carriage 26 is reciprocated within the printing device to contact and ink the indicia, in the prior art structures, there is a tendency for the inking roller 22 to occasionally move out of its prepositioned location within the housing. This could cause the roller 22 to improperly contact the indicia, or for the roller 22 shaft ends to improperly contact the side frames of the printing device due, for example, to off-center mounting. The inking roller 22 could become skewed periodically within the housing which is supporting it to thereby force the roller 22 out of its housing, jam the printing machine or cause inadequate or uneven inking and printing. There also is on occasion, the possibility of the entire cartridge 20 being moved out of one or both of its cartridge supports. In this case, the operator would have to return the cartridge 20 to its supports to use the postal meter.

The present invention eliminates these particular problems with an overall improvement in the efficient operation of any value printing device in which the invention is utilized.

The inking cartridge 26 and its supports 21 and 23 of the present invention are now described more specifically and with particular reference to FIGS. 3 through 6 inclusive. The cartridge 20 comprises the housing 24 having at least a portion of one wall, the upper wall 30, open and an inking roller 22 adapted to be rotatably mounted within the housing at its ends. The cartridge is utilized in the printing device by being moved by the carriage 26 into and out of contact with the indicia on the indicia member 16 for the inking function. In FIG. 6, the cartridge 20 is illustrated in broken away fashion for a better understanding of the various construction features.

The housing 24 in this particular embodiment is preferably an elongated, essentially rectangular box open at the top wall 30. It is split, as shown in FIG. 6, in the middle solely for illustrative purposes. The inking roller 22 is typically comprised of a porous resilient material, sponge-like in nature, which is capable of holding a given supply of ink material. It surrounds a shaft 39 extending through a central aperture in the roller 22, emerging at the opposite ends thereof. The shaft 39 is preferably formed of a hard, lightweight material, such as a steel shaft for effective rotation on its supporting structure during operation.

The ends of the housing 24 include slots or recesses 36 to receive the ends of shafts 39 of the inking roller therein. The ends of the housing 24 are further fitted within U-shaped lugs 38 which also provide additional support for the shaft ends. In this embodiment, the lugs 38 provide a basic coupling support structure for detachably coupling the cartridge 20 to a reciprocable carriage 26. The housing 24 may be constructed of any suitable material, preferably a plastic. Additional ribs 40 may be used to provide further strength to the housing. Although the inking roller 22 is mounted for rotation on a continuous shaft 39 in this illustration, any suitable rotational means may be provided such as individual pins mounted wihtin the ends of the roller 22.

The inking rollers heretofore used in these types of devices were generally designed to be disposable when the supply of ink held therein had been exhausted to the point where the postage impressions became faint or illegible. The operator can determine this by inspection of the quality of the postal impression as the machine is used over a period of time. When the roller 22 reaches the end of its useful life span, the operator then removes the spent roller 22 by use of a special tool which is designed to grip each end of the roller shaft, thus enabling the operator to lift the roller from its seating in the carriage supports. As mentioned above, this tool must be kept handy. If it is not or if it is misplaced, the operator must find some way of manually removing the roller with the risk of staining the hands and/or clothing. Of course, the new roller 22 must be replaced manually as well.

Figure 2:
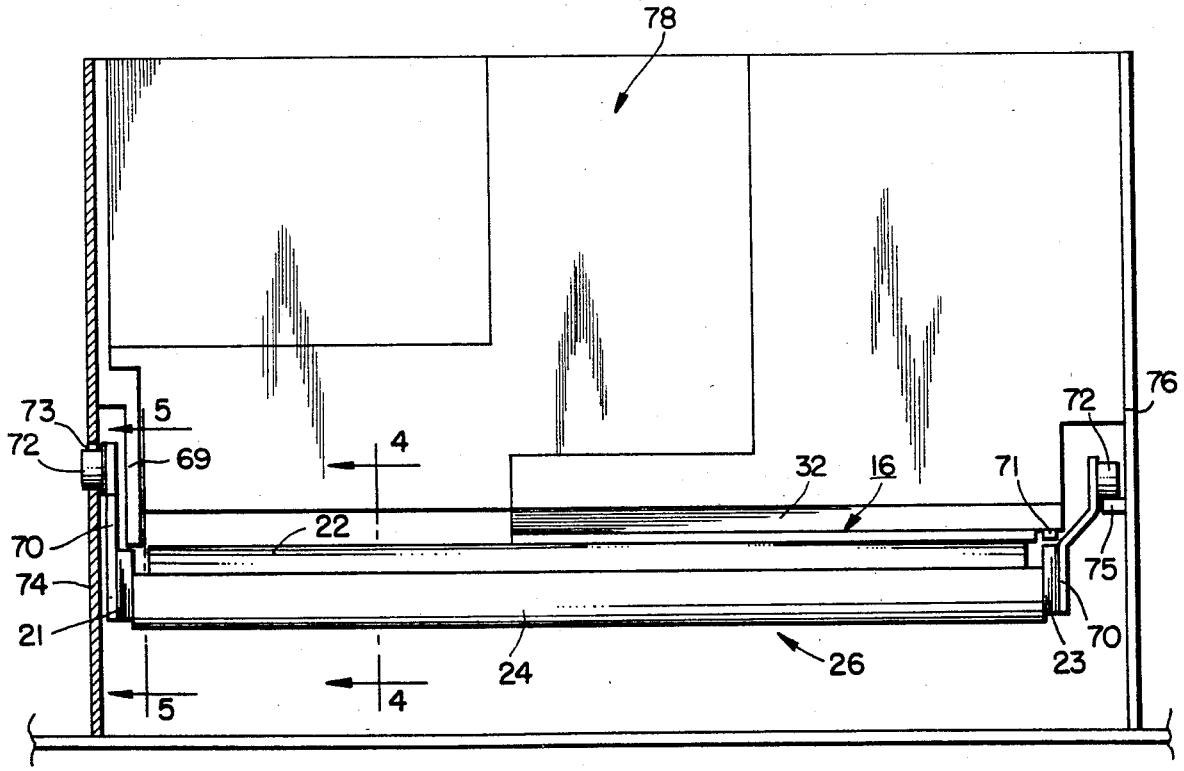
FIG. 2 is a front elevational view of the flat-bed postage meter shown in FIG. 1, with parts removed and other parts shown in cross section, to illustrate internal constructions of the device.

The housing 24 of the present invention, as particularly shown in FIGS. 2 and 6, is equipped with one or, more preferably, two handles 44 so that the housing 24 and inking roller 22 can be inserted into or removed from the device without direct operator contact with the roller 22. In this primary preferred embodiment, the handles 44 are in the form of foldable flaps 46 which are either molded onto the housing or are attached thereto by hinges 48 at their exterior edges. They are adapted for movement into and away from the front face of the housing supported by the hinges 48. Obviously, since the cartridge 20 is designed to be moveable within the printing device, the handles must not disadvantageously interfere with such movement for the placing of postage impressions on the mailpiece.

The handles 44 can be secured against the housing 24 by means of locking tabs 50 and 52 at the upper and lower edges, respectively, of the handles 44. These are designed to have interiorly projecting ridges 54 and 56 to be inserted over receptively-shaped upper and lower edges 58 and 60 of the housing 24. The spacing between the facing internal edges of the tabs is slightly smaller than the opposite front edges of the housing 24 to which they are secured while the machine is in operation. This results in a positive gripping when the machine is in operation but enables a yielding of the handles 44 away from the housing 24 when being removed by the operator. When the operator applies pressure to the handles 44 to swing them away from the housing 24, the ridges 54 and 56 pass over the edges of the housing 24. Chambered interior edges 62 are provided on the flaps for manual gripping of the flaps when putting the flaps from their operative, locked positions for changing the inking rollers of cartridges.

Figure 3:
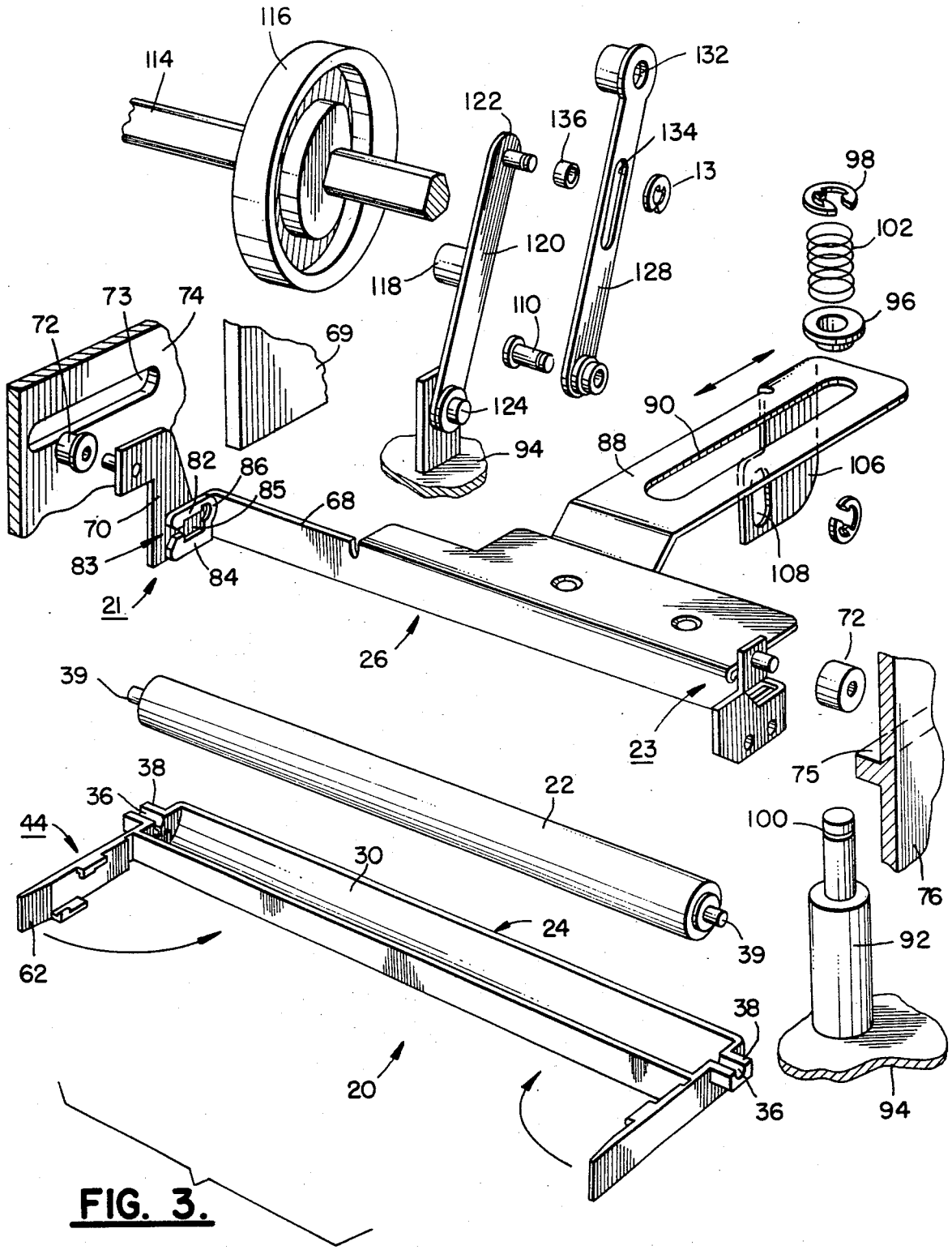
FIG. 3 is an exploded front perspective view of the preferred inking cartridge, carriage, side frames and motion imparting mechanisms of the present invention.

When the cartridge 20 is to be maneuvered by the operator, the tabs 50 are held in the open position as shown in FIG. 3 so that they can be manually gripped. When the cartridge 20 is being stored or is in place in the device, the handles 44 are secured against the housing 24 through the use of the resilient tabs 50 and 52. The handles 44 are shown in the closed position in FIG. 4.

One embodiment of the detachably-coupled aspects of the cartridge to the carriage are illustrated in FIGS. 4 and 5. FIGS. 4 and 5 shows a vertical cross section of the roller 22 secured through shaft 39, with the shaft ends resting on the U-shaped lugs 38 of the housing ends. The inking roller 22 itself is of a width less than the width of the housing 24 as measured from the inside surfaces of the housing 24 ends. When the shaft 39 of the roller 22 is resting in slots 36 for rotational configuration within the housing 24, the bottom of the roller 22 clears the bottom of the housing 24 so as to be free for rotation. The top surface of the roller, on the other hand, extends above the housing 24 wall at least enough to ink the print characters without the housing coming into contact with the printing head. Within these parameters, any suitably geometrical configuration may be utilized without departing from the concept of the present invention.

Referring now to FIG. 5, the inside of the housing is illustrated in vertical cross section. This figure also shows that the shaft 39 rests for rotation on the opposite end lugs 38 located on the exterior ends of the housing. The slots 36 in the housing tapers downwardly to an area which, desirably, is smaller than the width of the diameter of the shaft such that the shaft 39 is fit or loaded or snapped into the ends of the housing. With this arrangement, the roller is free to rotate within the lugs. As can be understood, upward motion of the roller within the housing is to be resisted. Support for the cartridge 20 and resistance to upward or other movement of the shaft 39 of the roller is basically effected by the carriage supports 21 and 23, one of which is located on each end of the reciprocating carriage 26.

The supports 21 and 23 are preferably constructed of a relatively hard, resilient, rigid plastic and mounted at their lower rear portions to the tie bar 68 of the carriage 26. The exterior, lower sides of the supports 21 and 23 are mounted to upstanding brackets 70, the upper ends of which brackets are rotatably supported on rollers 72. The lower portions are those portions generally below the pivot zone 86 in the Figures. Nylon has been found to be a suitable material for the rollers 72 and supports 21 and 23. The rollers 72 are adapted to reciprocate on fixed support slot 73 and shelf 75. The support slot 73 is located in side frame 74 and shelf 75 is located on side frame 76.

Also located above the inker carriage supports 21 and 23 are security rails 69 and 71, respectively. Security rail 69 is mounted on die shelf 78 while security rail 71 is mounted on the printhead. Rails 69 and 71 remain stationary while supports 21 and 23 move with the carriage relative thereto. The function of security rails 69 and 71 is to insure that the upper resilient portion or member 82 of the carriage supports 21 and 23 remains approximately in the position shown in the figures to preclude inadvertent upward motion of the roller, shaft or housing as might otherwise inadvertently occur through excess interference against the indicia or of the edge ends of the shaft against the side frames of the machine. The importance of this freature is now described in the general context of loading and unloading the cartridge from the cartridge and the cycle for inking the indicia on the printhead.

The loading of the cartridge 20 into the carriage supports 21 and 23 is carried out as follows. The operator opens up the handles 44 and guides the portion of the cartridge containing the roller 22 and the housing 24 towards the supports 21 and 23. The outermost elements on the sides of the cartridge 20 in this embodiment are the ends of lugs 38 carrying shaft 39. The lugs are guided into the mouth or opening 83 of cartridge supports 21 and 23.

Each of carriage supports 21 and 23 may be configured in the same manner, such as shown in FIGS. 3, 5 and 6. They have a lower member 84 which is fixedly mounted to brackets 70 and tie bar 68, an upper member 82 and a pivot zone 86 joining members 82 and 84. These elements form a predetermined or normal configuration for the supports 21 and 23, a mouth or aperture area 83 existing between the upper and lower members 82 and 84 on the side of the carriage facing the front of the postal meter and an inner region 85 in which the cartridge can be seated.

Any suitable material can be used for the carriage supports 21 and 23 which enables them to function in the manner intended. The material is preferably resilient so that when the pivot zone 86 and upper member 82 are moved by force relative to the fixed lower member 84 (so as to deform or distort the predetermined or normal configuration of the support) the carriage supports 21 and 23 will recover to their predetermined configurations when the force causing the distortion is released. Mouth 83 is smaller than lugs 38 when the supports 21 and 23 are in their predetermined configuration.

Because of the resilience of the upper member 82 and the pivot zone 86, the cartridge can be readily loaded into and unloaded from the carriage supports. Loading occurs by the operator pushing lugs 38 into the mouth 83 of supports 21 and 23. The mouth 83 is forced open by the upper member 82 moving upwards thereby distorting its predetermined shape and allowing the lugs 38 to pass into the inner region 85 of the supports 21 and 23. Once the lugs 38 are pushed beyond the mouth and into the inner region 85 of supports 21 and 23, the force on the upper member 82 by the lugs 38 being pushed into the supports 21 and 23 is released and the supports 21 and 23 recover their predetermined configuration, the mouth 83 closing to its original size on the proces. At this point, the lugs 38 are seated within inner region 85 and "trapped" there since the size of the mouth 83 is narrower than the size of the lugs. Unloading of the cartridge 20 occurs by the operator pulling the cartridge out of the supports 21 and 23 when the carriage is in its home position.

The cartridge 20 is now loaded onto the carriage 26 and the carriage is reciprocated from its home position into the machine and across the printhead to ink the indicia thereon. Once this is done and the meter prints the postage onto the envelope, the carriage 26 is moved back to its home position to complete its inking cycle.

Generally, the forces on the roller 22 during its reciprocating motion with the carriage are insufficient to force the lugs 38 out through the mouth 83 of supports 21 and 23. However, there is some possibility that such forces may build up to a point during a cycle of the carriage 26 that they are sufficient to push the ends of shaft 39 up out of the lugs 38 or the lugs 38 back out through the mouth 83 and dislodge the cartridge 20 from the carriage 26.

To prevent this from happening, security rails 69 and 71 are provided to keep the mouths 83 in their predetermined configurations (so that they cannot open) during the cycle of the carriage 26. Rails 69 and 71 are located over the upper members 82 of the supports 21 and 23. The rails are positioned so that at least during the portion of the carriage cycle that roller 22 engages the printhead and force is applied onto the roller 22 due to its interference with the indicia, they prevent the upper member 82 from being forced up by the shaft 39 or lugs 38 to cause the mouth 83 to open. The rails 69 and 71 can be positioned to have the tops of upper members 82 loosely slide over their bottom edges, or alternatively, be positioned with suitable clearance above upper members 82 to function in the manner intended.

The rails 69 and 71 should, however, be shaped or positioned so that they enable the upper members 82 to move up when the carriage 26 is located in its home position and a cartridge 20 is to be loaded into or removed from the carriage 26. This can be done by having the security rails 69 and 71 extend towards the front of the postage meter only to the point where they do not interfere with the mouth opening 83 when the carriage 26 is in its home position. Alternatively, the rails 69 and 71 can extend completely over upper members 82 including the area where the carriage 26 is in its home position, but have a chamfer on other suitable shape in the home position area to allow the upper member 82 to move up for loading and unloading of the cartridge 20.

As indicated previously, and as illustrated in the patents above mentioned, the prior art ink rollers are mounted for rotation in a moveable carriage which reciprocates back and forth with a printing device in order to ink the characters. The same general concept is employed here.

Motion is imparted to the carriage housing 24 and roller 22 through means of the motion imparting mechanism shown in FIG. 3. Extending rearwardly of the ink carriage support bracket is an inwardly extending horizontal bracket or inker bracket 88 provided with a longitudinal slot 90 for guiding the motion of the carriage 26 and cartridge 20.

The bracket 88 is mounted so that a post 92 in the slot 90 guides the carriage 26 into and out of the printing device. The inker support post 92 is mounted at its lower end to the base 94 of the machine. The upper most part of the inker support post 92 is reduced in diameter for being received within the slot 90. Above the horizontal bracket 88 is a washer 96 which is mounted on the upper segment of the inker support post 92 for providing the bearing surface for the bracket 88. The keeper 98 is releasably mounted in a keeper slot 100 in the inker support post 92 with a spring 102 located between the keeper 98 and the washer 96 to maintain the mechanism to their proper horizontal orientation. A downwardly extending plate or inker bracket extension 106 extends from the horizontal bracket 88 and is also provided with a slot 108 for reception of a drive stud 110. Stud 110 is kept in slot 108 by keeper 109.

As can be seen, rotation of the drive shaft 114 from the main motion imparting mechanism of the postal meter rotates the inker bracket drive cam 116 to reciprocate the follower 118 on the first intermediate link 120. The pin 122 at its upper end of link 120 thus oscillates in accordance with the cam profile to pivot the link 120 about an axis through the fixed pivot pin 124 at the lower end of the first intermediate link 120.

Motion is imparted to the second intermediate link 128 through the first intermediate link 120. The second intermediate link 128 has an upper end pivotally mounted on a fixed pin, not shown, mounted to a frame member in the side of the machine through hole 132. The upper end of the first intermediate link 128 includes a drive stud or pin 122 mounted through a slot 134 in the second intermediate link 128 through a spacer member 136 and keeper 138. The lower end of the second intermediate link 128 supports the drive stud 110.

The drive stud 122 is located within the slot 134 and positioned by another keeper 138 mounted in the ring of the stud 122 for securing the drive stud 122 in location through the slot 134 of the downwardly extending member 128. The spacer 144 maintains the proper spacing.

The drive stud 122 is thus provided with a reciprocal motion to horizontally reciprocate the vertical and horizontal segments of the carriage 26, as shown by the arrow next to bracket 88, and inking roller 22 in a manner designed for the specific purpose of the present apparatus. Specifically the 360 degree rotation of the cam quickly moves the carriage 26 from its home position to ink the indicia. Then, as the printing event is occurring, the carriage slowly dwells within the meter until the printing is completed. The carriage 26 is then rapidly returned to its home position. The profile of the cam acts through the various linkages to provide the desired movements.

Other embodiments of the cartridge and its associated carriage supports are possible and are included in the general concept of this disclosure. For instance, the predetermined configuration of the supports can be any suitable one which enables them to be distorted to load and unload the cartridge 20 and then recover to its predetermined configuration after loading and unloading has occurred. Also, the shafts 39 of the cartridge 20 could extend beyond the lugs 38 and be the principal engagement means between the supports 21 and 23 and cartridge 20. In this case, the housing 24 would be held onto the shaft 39 by the acting of recesses 36, in the housing 24 snapping onto the shaft 39 and the mouth 83 would have to be sized smaller than the shaft 39.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. Apparatus for inking the print characters of a value printing device comprising:

(a) a cartridge having a housing and an inking means for imparting printing ink to said print characters of said device;

(b) a carriage member including:

means for detachably mounting said cartridge to said carriage in a fixed position relative thereto, a bracket member having a generally elongated slot, said device having a fixably mounted post having a portion of said post extending through said bracket slot and slidably mounted therethrough such that said carriage can slidably experience longitudinal reciprocating motion thereon and guide mean constituant to said device for guiding said carriage in a defined longitudinal path;

(c) a drive shaft having a cam centrally and fixably mounted thereto (d) a linkage assembly including:

a first link member pivotal mounted at one end about a fixed point in said device, and coupled to said cam at a point there along, said first link member extending generally radially relative to said cam and driven by said cam such that rotational motion of said cam by said drive shaft causes reciprocating articular motion of said first link member, a second linkage member having a slot located therealong and pivotally mounted at one end at a fixed position in said device, said first link member having a pin fixably mounted at its other end and sidably confined in said slot of said second link, said bracket member having a bracket extension, generally parallel to the plane of said bracket slot said bracket extension having a generally elongated slot, said bracket extension slot elongation being generally orientated perpendicular to said elongation of said slot in said bracket, a second pin traversing and pivotally mounted in said second link member's other end and slidably mounted in said bracket extension slot, whereby rotational motion of said drive shaft causes said cam to pivot said first link member which in turn pivotally displaces said second link member which then in turn causes said carriage to linearly displace reciprocally along said path defined by said guide means.

(e) said slots being so located and of suitable elongation to cooperatively engage said respective pins so as to define a cycle of operation per rotational cycle of said cam wherein said carriage is displaced traversely from a home position to a inking position, subsequent thereto said carriage is caused to dwell and further subsequently said carriage is reciprocated to said home position.

* * * * *